US006874877B2

(12) United States Patent
Gaston et al.

(10) Patent No.: US 6,874,877 B2
(45) Date of Patent: Apr. 5, 2005

(54) INK CONDENSATE REMOVAL IN HARDCOPY APPARATUS

(75) Inventors: Gonzalo Gaston, Barcelona (ES); Antonio Monclus, Barcelona (ES); Lluis Valles, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 15 days.

(21) Appl. No.: 10/285,352

(22) Filed: Oct. 30, 2002

(65) Prior Publication Data

US 2003/0103099 A1 Jun. 5, 2003

(30) Foreign Application Priority Data

Oct. 31, 2001 (EP) ..... 01125980

(51) Int. Cl.[7] ..... B41J 2/175
(52) U.S. Cl. ..... 347/86; 347/85
(58) Field of Search ..... 347/17, 18, 22, 347/84, 85, 86; 359/250

(56) References Cited

U.S. PATENT DOCUMENTS

| | | | | |
|---|---|---|---|---|
| 5,157,421 A | * | 10/1992 | Kitahara | 347/86 |
| 6,176,563 B1 | * | 1/2001 | Anderson et al. | 347/22 |
| 2001/0002952 A1 | | 6/2001 | Sakai | 399/250 |

FOREIGN PATENT DOCUMENTS

| | | |
|---|---|---|
| EP | 0 816 097 A2 | 1/1998 |
| FR | 2 618 727 | 2/1989 |
| FR | 2 709 092 | 2/1996 |
| GB | 2 010 104 | 6/1979 |
| WO | 93/17869 | 9/1993 |

OTHER PUBLICATIONS

Abstract of JP 02–026751, *Patent Abstracts of Japan*, (1990).
Abstract of JP 06–226991, *Patent Abstracts of Japan*, (1994).
Abstract of JP 08–216428, *Patent Abstracts of Japan*, (1996).
Abstract of JP 11–014258, *Patent Abstracts of Japan*, (1999).

* cited by examiner

*Primary Examiner*—Anh T.N. Vo

(57) ABSTRACT

Vapour removed from the drying chamber of a hardcopy apparatus is condensed and passed to a reservoir from which it is intermittently pumped into an ink supply cartridge. Cartridge supplies ink from a first bag via a first nozzle. As the first bag contracts, it allows a second bag to expand to receive the condensate from reservoir via a valving system and a second nozzle. In addition, a pump supplies air the second bag via piping; by switching over the valving system, it is the same pump which is used to transfer the condensate from reservoir to the cartridge.

30 Claims, 4 Drawing Sheets

INK CONDENSATE REMOVAL IN HARDCOPY APPARATUS

FIELD OF THE INVENTION

The present invention relates to hardcopy apparatus, such as ink-jet printers, which consume ink. In particular it relates to an arrangement for removing the ink waste products, usually predominantly water, from the hardcopy apparatus.

BACKGROUND OF THE INVENTION

The ink used in ink-jet printers comprises typically 20% by volume of pigment or dye with traces of various additives, some of which are volatile. The balance, i.e. substantially 80%, is water. When a swath of such ink is deposited on a print media it requires a drying time before the next swath is printed to avoid bleeding problems between the swaths. An end of plot drying time is also required to avoid ink becoming smeared during transfer of the print media to the next stage.

To allow the ink to dry naturally takes a relative long time, which has an adverse effect on throughput, so inkjet printers and other hardcopy apparatus which are in heavy use are provided with active drying systems, which eliminate moisture content from the printed surface as quickly as possible. Typically the active drying system comprises a fan and ducting system to blow air over the ink in the print zone, and/or a heater arranged under the printing platen to evaporate the moisture.

Since the vapour created by the drying system is predominantly water, the atmosphere in a room containing a hardcopy apparatus in heavy use can become unacceptably humid, with condensation forming on windows and walls. A large ink-jet printer can produce approximately 1 litre of water per hour.

Accordingly, various methods have been proposed to prevent discharge of the water vapour to the environment. In one method, the vapour emerging from the printzone is condensed and conveyed outside of the hardcopy apparatus, for example to a nearby drain. This has the disadvantage of requiring an external hose connection and requires the apparatus to be located close to a local drain. Moreover, since the condensate will contain chemicals in the form of volatile constituents and unused ink, there may be environmental considerations which do not allow the condensate to be discharged in this way.

In another method, the condensate is collected in a dedicated container within the hardcopy apparatus. This has the disadvantage of requiring within the apparatus additional space which needs to be readily accessible. In addition, time and effort are required to empty the container. The container also requires maintenance. Problems can also arise if the user or service engineer forgets to empty the container before it is full.

SUMMARY OF THE INVENTION

Certain aspects of the present invention seek to overcome or reduce one or more of the above problems.

According to a first aspect of the present invention there is provided a method of handling condensate from the printzone of hardcopy apparatus comprising the steps of supplying ink from one or more ink cartridges to said printzone, using said ink in a printing operation in said printzone, and, during part of said printing operation, feeding said condensate to said one or more ink cartridges and, during another part of said printing operation, feeding air to said one or more ink cartridges.

Preferably the condensate is fed to the ink cartridge or one of the cartridges simultaneously with ink being extracted from the cartridge for printing. This provides at least part of the pressure needed to transfer the ink from the cartridge(s) to the printzone. Air is fed to the cartridge simultaneously with ink extraction. This is of assistance since the volume of the condensate is normally less than the volume of the ink removed.

According to a second aspect of the present invention, there is provided a hardcopy apparatus employing ink from one or more ink cartridges and including a printzone where vapour is produced, means for condensing said vapour to produce a condensate and means for feeding said condensate to said one or more ink cartridges, wherein means are provided for supplying air to said one or more ink cartridges.

The material collected in the condensing means may include droplets of ink which have not been vapourised, i.e. have remained in liquid form. The term "condensate" is to be understood as including such material.

In addition, the hardcopy apparatus may have a service station including at least one spittoon for receiving ink from a respective print head in a print head servicing operation. The ink collected by the spittoon is waste ink, which may also be fed to the ink cartridges. The term "condensate" is further to be understood as including such waste ink.

Preferably the air supply means is a pump and a valving arrangement is provided in a first switched configuration of which said pump supplies air to the cartridge and in a second switched configuration of which said pump causes condensate to be fed to the cartridge. This has the advantage that a single pump is used to transfer the air and condensate to the cartridge.

According to a third aspect of the present invention, there is provided an ink cartridge for hardcopy apparatus, said cartridge having an interior and first and second nozzles, said interior comprising a bag and an interior region external to said bag, said first nozzle being in communication with the inside of the bag and said second nozzle being in communication with said interior region.

An advantage of this arrangement is that use of the space within the cartridge is optimised. Another advantage is that used cartridges and their contents can be easily recycled.

BRIEF DESCRIPTION OF THE DRAWINGS

A preferred embodiment of the present invention will now be described, by way of example only, with reference to the accompanying drawings, of which.

It will be appreciated that the drawings are intended for the purpose of explanation and are not to scale.

DETAILED DESCRIPTION OF THE PREFERRED EMBODIMENT

Figure 1:
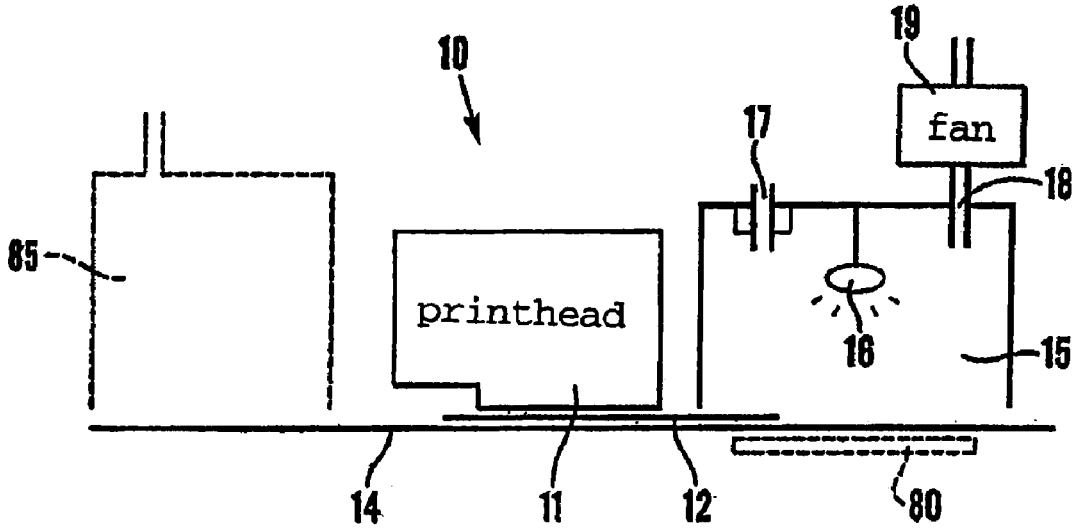
FIG. 1 is a schematic side view of the print zone of an ink-jet printer in accordance with a first embodiment of the present invention.

Referring to the drawings, FIG. 1 shows the print zone 10 of an ink-jet printer comprising a printhead 11 arranged to fire ink drops to deposit ink on a print media 12 travelling across a print platen 14. As the media 12 moves from printzone 11 from left to right in FIG. 1 it enters a drying chamber 15. Here the media 11 is subjected to heat produced by a heating lamp 16 arranged within chamber 15. The relative humidity within the chamber 15 can exceed 90%. The chamber 15 thus contains an aerosol comprising both small ink droplets, which have been ejected but have not been deposited on the print media, and vapour (predominantly water) caused by evaporation from the drying ink. This aerosol is removed by an air ducting system comprising an air inlet 17 and an air outlet 18 which has an extractor fan 19.

Figure 2:
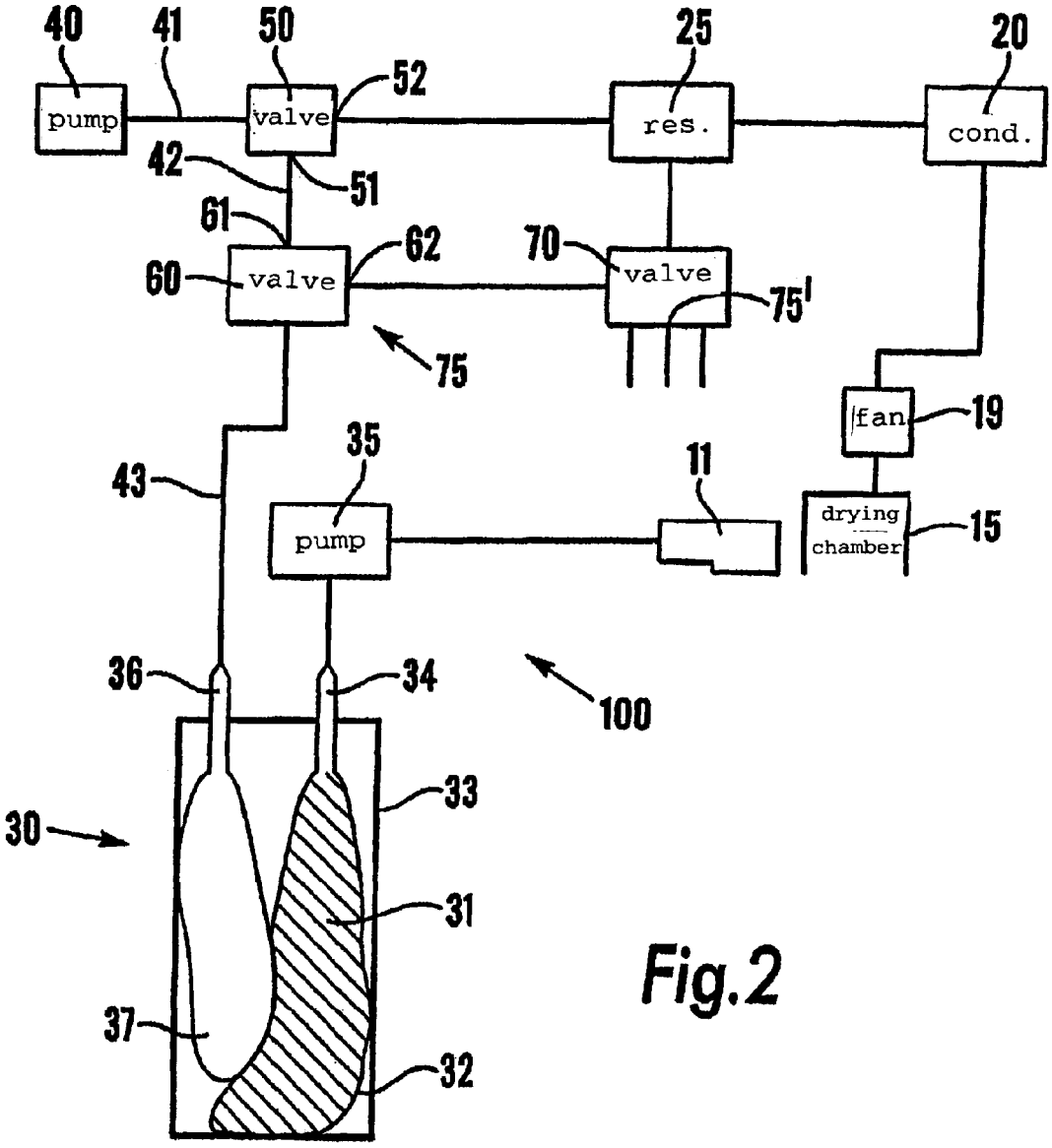
FIG. 2 is a schematic view of an ink supply and drying system for the printer of FIG. 1.

The extracted vapour is then fed to a condenser 20, FIG. 2, which produces a condensate of water contaminated with unused ink and volatile components. The condensate is passed to a reservoir 25.

FIG. 2 shows generally an ink supply system 100 for the print zone 10 of FIG. 1. Ink 31 for printhead 11 is supplied in a replaceable cartridge 30 comprising a rigid plastics container 33. To prevent the access of air to the ink 31 it is held within container 33 inside an impermeable and collapsible plastics bag 32 having a mouth in communication with an outlet nozzle or port 34. When printing occurs, a volumetric pump 35 is actuated to transfer ink 31 from bag 32 via nozzle 34 to printhead 11.

It is known with certain ink-jet cartridges, e.g. Hewlett-Packard types 80, 81 and 83, to inject air into the container 33 to urge ink out of the bag 32. The extraction of ink is controlled by the volumetric pump 35, but the required pumping effort is reduced by the injection of air around the bag 32. In the present embodiment, air is supplied from an air pump 40 via tubing 41, 42, 43 to an inlet nozzle 36 of the cartridge 30. However, in the present embodiment, an intermediate valving arrangement 75 is additionally provided. In particular, air pump 40 is connected to the input of a two-way switching valve 50. When the valve 50 is switched to a first outlet 51, air is admitted to a first input 61 of a second switching valve 60. The outlet of valve 60 is connected to an inlet nozzle or port 36 of the cartridge 30 which is connected to the mouth of a second impermeable and collapsible plastics bag 37 within container 33.

The ink-jet cartridge 30 is supplied when new with bag 32 full of ink 31 and occupying most of the volume within container 33. At this stage, bag 37 is in a collapsed state and occupies only a small volume. As pump 35 extracts ink from the bag 32 it becomes smaller and pump 40 is operated to expand bag 37 to occupy the space which is now available. When cartridge 30 is finished, bag 32 is substantially empty of ink and in a collapsed state and bag 37 is substantially expanded state.

In use, the prior art Hewlett-Packard cartridges were injected solely with air as the ink left its bag. In use of the present embodiment, condensate from the reservoir 25 is injected into the cartridge at certain times. Thus when valve 50 is switched to a second outlet 52 connected to reservoir 25, condensate is pumped via a third switching valve 70 to a second input 62 of valve 60 and from there into bag 37. The level of condensate in reservoir 25 is monitored so that it never becomes full and control means are provided so that valves 50, 60 operate in ganged manner. The printer has four printheads, and switching valve 70 has a plurality of further outlets 75', which serve to share the condensate among the four ink-jet cartridges as they empty.

In use, cartridge 30 is inserted into the printer. During printing operations, ink is extracted from nozzle 34 and air and condensate are pumped into nozzle 36. After use, the spent cartridge 30 is removed.

An advantage of the above-described arrangement is that no special operation is needed to remove the condensate. It is automatically removed simultaneously with the normal removal of a spent ink-jet cartridge, which is, of course, readily accessible. Only a small space is required for reservoir 25 and it does not need to be located in an accessible position. The arrangement is environmentally-friendly since no liquid effluent needs to be discharged via hosing and there are minimal vapour emissions from the print zone. A common pump 40 is used to transfer both air and condensate into the bag 37.

Various modifications may be made to the above-described arrangement. For example the air inlet 17 may be omitted in which case air enters solely at the bottom of the chamber 15.

Moreover, an additional print media drying and moisture extraction unit 85, positioned before the print zone 11 in the media axis, may be provided with its own separate connection to the condensing circuit. In another modification, the ink in the printzone may be heated instead or in addition by a resistor 80 located underneath the media path. A hot air circulation system may be provided, with the air being heated remote from the printzone.

Figure 3:
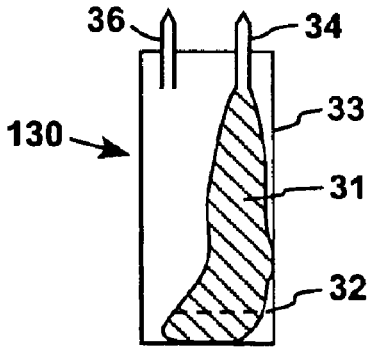
FIGS. 3 and 4 are schematic views of respective modified ink cartridges for use in the system of FIG. 2.

If container 33 is sufficiently airtight, the bag 37 may be omitted as shown in the modified cartridge 130 of FIG. 3. In this case, the air and condensate occupy the interior of the container 33 not occupied by bag 32.

Figure 4:
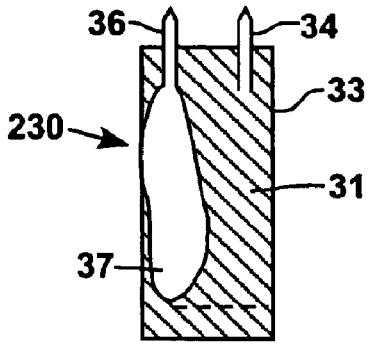

As shown in the modified cartridge 230 of FIG. 4, bag 32 may be omitted instead of bag 37, in which case ink 31 occupies the remainder of the interior not occupied by bag 37. Instead of a bag or bags, the regions within the interior of the cartridge may be separated by a flexible membrane. Initially, the ink is contained between one side of the membrane and part of the walls of the container 33; when the ink has been used up, air and condensate are contained between the other side of the membrane and the remaining part of the walls.

For hardcopy apparatus with a single printhead, valve 70 may be omitted.

Instead of pump 40, a separate pump may be used to transfer condensate from the reservoir 25 into the cartridge 30.

Volumetric pump 35 may be omitted, in which case the injection of air or condensate by pump 40 into bag 37 is used to directly control the flow of ink 31 to printhead 11.

With a suitable control arrangement, reservoir 25 may be omitted and the outlet tube from condenser 20 may be connected directly to the valving arrangement 75. Furthermore the valving arrangement 75 may be omitted, in which case the output from condenser 20 may pass straight through into bag 37, additional air being pumped in as necessary. The output from condenser 20 may reach the bag solely under the forces of gravity, but a pumped arrangement is preferred, especially when the cartridge still contains a large amount of ink and considerable pressure is required.

In another modification, an ink cartridge is employed with only one nozzle. In this case, condensate is collected in reservoir 25 until the ink bag in the cartridge is substantially empty of ink. Before removal of the cartridge, the condenser is connected to the nozzle by means of a suitable valving arrangement and the condensate is transferred into the ink bag. A suitable operating arrangement may be provided having a button which is actuated to initiate an ink cartridge replacement procedure. Before allowing access to the ink cartridge, the operation arrangement may effect the condensate transfer process automatically.

Figure 5:
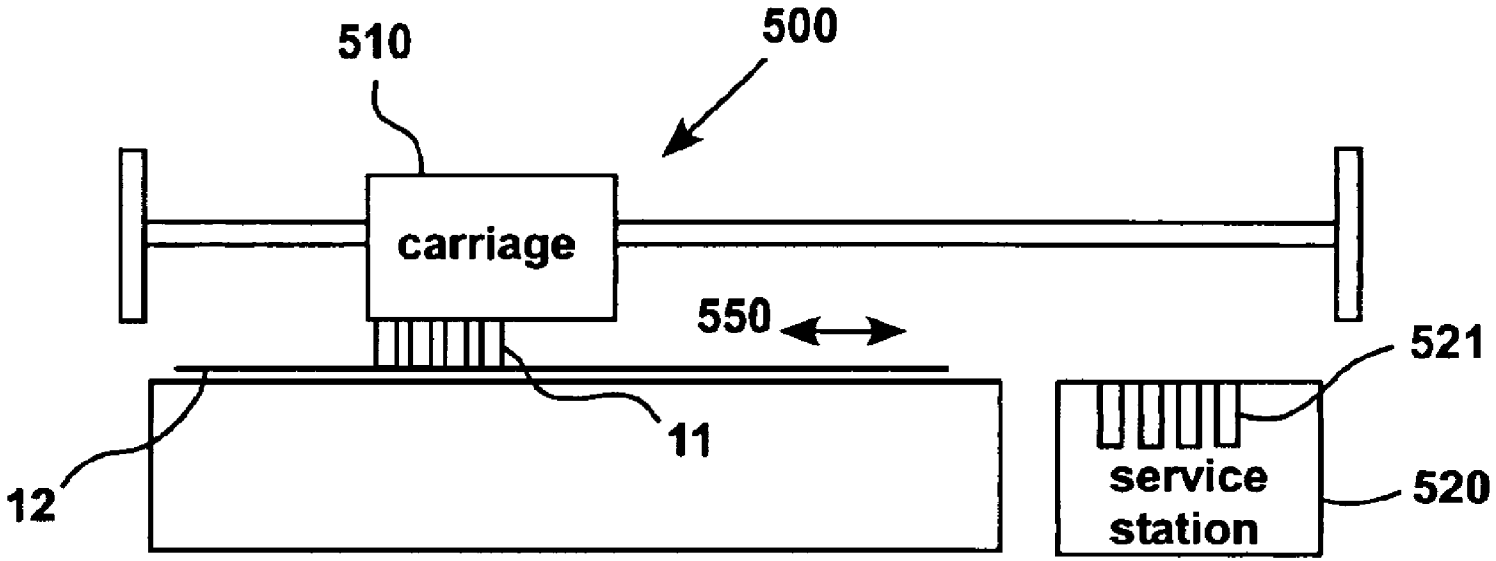
FIG. 5 is a schematic view of an ink-jet printer in accordance with a second embodiment of the present invention.
Figure 6:
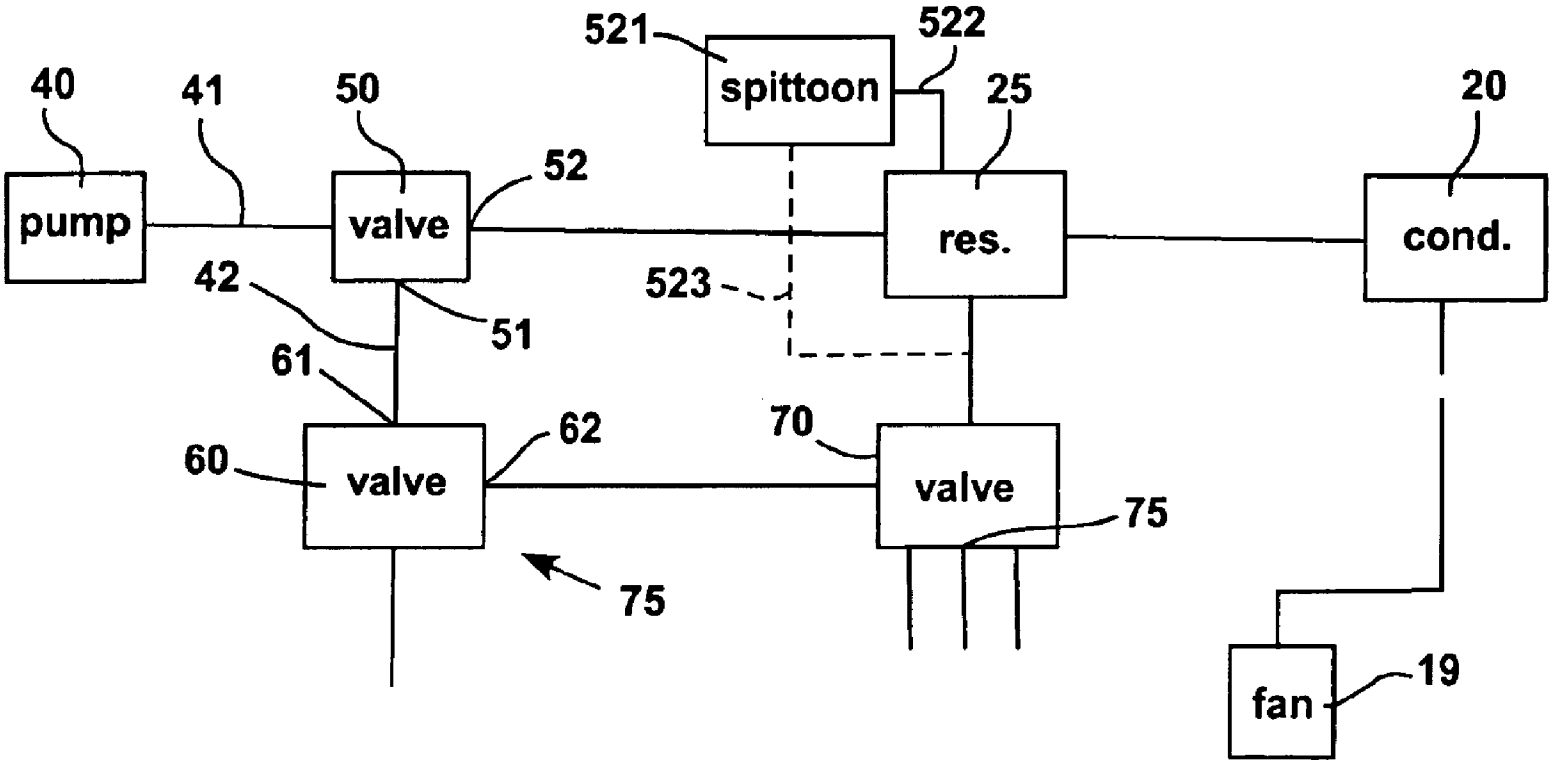
FIG. 6 is a schematic view, corresponding to part of FIG. 2, of an ink supply and drying system for the printer of FIG. 5.

In a printer 500 in accordance with a second embodiment of the present invention, FIGS. 5 and 6, printheads e.g. 11 are mounted on a carriage 510 which moves in both directions along a scanning axis indicated by a double-headed arrow 550. At one end of the scanning axis there is provided a printhead service station 520, which performs servicing operations on the printheads 11. One of the operations comprises "spitting", in which a small volume of ink is ejected from printhead 11 into a receptacle 521 in the service station 520. The receptable for receiving the ink is known as a "spittoon". To avoid the problem of waste ink collecting in spittoon 521, a fluid outlet connection 522 is proivided which connects spittoon 521 to reservoir 25. Thus waste ink from spittoon 521 is transferred with condensate from condenser 20 back to the ink cartridges 33.

In a modification, ink from spittoon 521 is instead connected via a fluid connection 523, indicated in a broken line in FIG. 6, to the outlet of reservoir 25.

The above described arrangements may be used in other forms of hardcopy apparatus including plotters, scanners, photocopiers and facsimile machines.

What has been described and illustrated herein is a preferred embodiment of the invention along with some of its variations. The terms, descriptions and figures used herein are set forth by way of illustration only and are not meant a's limitations. Those skilled in the art will recognise that many variations are possible within the spirit and scope of the invention, which is intended to be defined by the following claims and their equivalents in which all terms are meant in their broadest reasonable sense unless otherwise indicated.

What is claimed is:

1. A method of handling condensate from a printzone of hardcopy apparatus comprising the steps of supplying ink from one or more ink cartridges to said printzone, using said ink in a printing operation in said printzone, and, during part of said printing operation, feeding said condensate to said one or more ink cartridges and, during another part of said printing operation, feeding air to said one or more ink cartridges.

2. A method according to claim 1, wherein said ink is extracted from a first port of said one or more ink cartridges and said condensate and/or air is fed to said one or more ink cartridges via a second port.

3. A method according to claim 1, wherein the step of feeding said condensate includes feeding ink which has not been vapourised.

4. A method according to claim 3, wherein the step of feeding ink which has not been vapourised includes the step of feeding ink collected from a spittoon.

5. A hardcopy apparatus employing ink from one or more ink cartridges and including a printzone where vapour is produced, said apparatus including means for condensing said vapour to produce a condensate and means for feeding said condensate to said one or more ink cartridges, wherein means are provided for supplying air to said one or more ink cartridges.

6. A hardcopy apparatus according to claim 5, wherein said air supply means is a pump, and said hardcopy apparatus further includes a valving arrangement having first and second switched configurations, wherein, in said first switched configuration, said pump supplies air to said one or more ink cartridges, and in said second switched configuration, said pump causes said condensate to be fed to said one or more ink cartridges.

7. A hardcopy apparatus according to claim 5, wherein at least one cartridge of the one or more ink cartridges has first and second ports, ink passes from said at least one cartridge via said first port to said printzone and said feeding means passes said waste products or said air to said cartridge via said second port.

8. A hardcopy apparatus according to claim 7, wherein the at least one cartridge comprises a bag in communication with said first port.

9. A hardcopy apparatus according to claim 8, wherein the at least one cartridge comprises a further bag in communication with said second port.

10. A hardcopy apparatus according to claim 8, wherein the at least one cartridge has an interior, said interior comprising said bag and an interior region external to said bag, said second port being in communication with said interior region.

11. A hardcopy apparatus according to claim 7, wherein the at least one cartridge comprises a bag in communication with said second port.

12. A hardcopy apparatus according to claim 11, wherein the at least one cartridge has an interior, said interior comprising said bag and an interior region external to said bag, said first port being in communication with said interior region.

13. A hardcopy apparatus according to claim 5 and further including means for collecting waste ink which has not been vapourised and means for feeding said waste ink with said condensate to said one or more ink cartridges.

14. A hardcopy apparatus according to claim 13 wherein said printzone comprises at least one printhead and said means for collecting waste ink comprises at least one spittoon for receiving ink from said printhead.

15. An ink cartridge for hardcopy apparatus, said cartridge having an interior and first and second nozzles, said interior comprising a bag and an interior region external to said bag, said first nozzle being in communication with the inside of the bag and said second nozzle being in communication with said interior region and said second nozzle being in communication with means for feeding condensate.

16. A method of handling condensate from a printzone of hardcopy apparatus, the method comprising:

supplying ink from one or more ink cartridges to said printzone;

using said ink in a printing operation in said printzone;

during part of said printing operation, feeding said condensate to said one or more ink cartridges; and during another part of said printing operation, feeding air to said one or more ink cartridges.

17. A method according to claim 16, wherein said ink is extracted from a first port of said one or more ink cartridges and said condensate and/or air is fed to said one or more ink cartridges via a second port.

18. A method according to claim 16, wherein the feeding of said condensate includes feeding ink which has not been vapourised.

19. A method according to claim 18, wherein the feeding of ink which has not been vapourised includes feeding ink collected from a spittoon.

20. A hardcopy apparatus employing ink from one or more ink cartridges and including a printzone where vapour is produced, said apparatus including:

a condensing apparatus condensing said vapour to produce a condensate;

a feeding apparatus feeding said condensate to said one or more ink cartridges; and an air supply apparatus supplying air to said one or more ink cartridges.

21. A hardcopy apparatus according to claim 20, wherein said air supply apparatus is a pump, and said hardcopy apparatus further includes a valving arrangement having first and second switched configurations, wherein, in said first switched configuration, said pump supplies air to said one or more ink cartridges, and in said second switched configuration, said pump causes said condensate to be fed to said one or more ink cartridges.

22. A hardcopy apparatus according to claim 20, wherein at least one cartridge of the one or more ink cartridges has first and second ports, ink passes from said cartridge via said first port to said printzone and said second device passes said waste products or said air to said cartridge via said second port.

23. A hardcopy apparatus according to claim 22, wherein the at least one cartridge comprises a bag in communication with said first port.

24. A hardcopy apparatus according to claim 23, wherein the at least one cartridge comprises a further bag in communication with said second port.

25. A hardcopy apparatus according to claim 23, wherein the at least one cartridge has an interior, said interior comprising said bag and an interior region external to said bag, said second port being in communication with said interior region.

26. A hardcopy apparatus according to claim 22, wherein the at least one cartridge comprises a bag in communication with said second port.

27. A hardcopy apparatus according to claim 26, wherein the one or more cartridge has an interior, said interior comprising said bag and an interior region external to said bag, said first port being in communication with said interior region.

28. A hardcopy apparatus according to claim 20 and further comprising:

a collection apparatus for collecting waste ink which has not been vapourised; and a waste feeding apparatus feeding said waste ink with said condensate to said one or more ink cartridges.

29. A hardcopy apparatus according to claim 28 wherein said printzone comprises at least one printhead and said collection apparatus comprises at least one spittoon for receiving ink from said printhead.

30. An ink cartridge for hardcopy apparatus, said cartridge having an interior and first and second nozzles, said interior comprising a bag and an interior region external to said bag, said first nozzle being in communication with the inside of the bag and said second nozzle being in communication with said interior region and said second nozzle being in communication with a feeding apparatus for feeding condensate.

* * * * *